United States Patent [19]

Bechmann

[11] Patent Number: 4,575,050

[45] Date of Patent: Mar. 11, 1986

[54] MOBILE CABLE WINCH

[75] Inventor: Peter Bechmann, Uffing, Fed. Rep. of Germany

[73] Assignee: Rotzler GmbH & Co., Fed. Rep. of Germany

[21] Appl. No.: 421,266

[22] Filed: Sep. 22, 1982

[30] Foreign Application Priority Data

Sep. 24, 1981 [DE] Fed. Rep. of Germany ..... 3138034
Aug. 31, 1982 [DE] Fed. Rep. of Germany ..... 3232402

[51] Int. Cl.[4] ..... B66D 1/36; B66D 3/00

[52] U.S. Cl. ..... 254/286; 254/382; 254/374

[58] Field of Search ..... 254/283, 284, 285, 286, 254/371, 374, 382, 266; 242/47.01, 47.08, 47.09, 47.1, 47.11

[56] References Cited

U.S. PATENT DOCUMENTS

| | | | |
|---|---|---|---|
| 42,864 | 5/1864 | Morgan | 254/374 X |
| 3,300,187 | 1/1967 | Saxe et al. | 254/284 |
| 3,957,217 | 5/1976 | Clemens | 242/47.01 |
| 4,225,118 | 9/1980 | Ottemann | 254/376 X |
| 4,225,119 | 9/1980 | Frommherz | 254/375 X |
| 4,381,807 | 5/1983 | Umezawa et al. | 242/47.01 X |

FOREIGN PATENT DOCUMENTS

| | | | |
|---|---|---|---|
| 931315 | 8/1955 | Fed. Rep. of Germany . | |
| 2364505 | 12/1972 | Fed. Rep. of Germany | 242/47.01 |
| 2517796 | 4/1976 | Fed. Rep. of Germany . | |
| 1022005 | 12/1952 | France | 254/284 |

*Primary Examiner*—Stuart S. Levy
*Assistant Examiner*—Katherine Jaekel
*Attorney, Agent, or Firm*—Ratner & Prestia

[57] ABSTRACT

In a portable cable winch the smooth shell of a motor-driven cable drum is provided with at least one conical surface having an angle of inclination corresponding to the angle of friction between the load-bearing cable and the cable drum. A clamping disk driven in synchronism with the cable drum pulls the load-bearing cable away from the smaller-diameter end of the conical surface and towards a cable storing means. The cable has applied thereto a clamping force which is transmitted as a pulling force back to the cable section to be drawn in via the conical surface. In an embodiment in which the shell of the cable drum is subdivided into two conical surfaces having identical angles of inclination but being disposed on the axis of the cable drum extending in opposite directions, it is possible also to employ the cable winch for raising and lowering loads upon the direction of rotation of the cable drum being reversed to alternatingly guide the cable onto the one or the other of the two conical surfaces. In both cases the cable drum is operated as a pull-through drum so as to prevent the individual turns of the cable from being superimposed, with the result that it is possible to drive the drum independently of the length of the cable by applying a constant invariable torque thereto.

38 Claims, 2 Drawing Figures

MOBILE CABLE WINCH

TECHNICAL FIELD OF THE INVENTION

The present invention relates to a portable cable winch comprising a cable drum having a smooth peripheral surface and adapted to be driven in rotation by means of a motor, the load-bearing cable being held in position thereon by means of a clamping force so as to form a plurality of turns on the drum.

BRIEF DESCRIPTION OF THE PRIOR ART

In most of the thus far known portable cable winches of the aforeindicated type the proximate end of the cable is in most cases clamped in position on the cylindrical shell of the cable drum by means of a clamping member which is bolted to the drum. It is from this clamping point that the clamping force acts, through the medium of said plurality of turns, on the cable to be drawn in, said clamping force being increased by the frictional forces occurring between the load-bearing cable and the cable drum or the part of the cable wound onto the drum in the form of one or a plurality of layers. In cases in which it is necessary for heavy loads to produce large pulling forces by means of the cable winch, it being an additional requirement for the load-bearing cable to be of relatively great length in order to permit the loads to be moved along correspondingly longer paths of travel, undesirable pressures will occur in the individual cable turns, such pressures tending to deform certain portions of the load-bearing cable with the result that where irregular cross sections are involved there is a constant risk of the load-bearing cable being fractured. Winding a load-bearing cable of great length in the form of a plurality of layers onto the cable drum results in another disadvantage which is to be seen in the fact that the torque to be produced by the drive motor is subject to constant variation as a function of the variation of the winding radius of the cable drum and that, as a result, said torque will no longer suffice to haul in a heavier load together with a cable of greater length. In order to avoid this disadvantage it will therefore be necessary to overdimension the entire winch, this, however, being apt to render difficult the construction of a mobile winch which is easy to handle.

From DE-PS No. 931 315 a stationary cable winch is known which comprises two cable drums each of which is provided with a tapered shell having grooves formed therein, the axes of said drums being slightly misaligned in space. In this known winch, the load-bearing cable is hauled in through the outermost groove provided on the larger diameter of one of the cable drums to be then guided in a tangential direction to the outermost groove provided on the larger diameter of the second cable drum whence the load-bearing cable is deflected through approximately one-half of the periphery of the drum to be guided back to the first-named cable drum wherefrom the cable is then guided back to the second cable drum until, after having been guided to and fro in the manner described, the cable is pulled off in a tension-free manner from the smaller diameter of said one cable drum for the purpose of being transferred into a cable store constituted by a supply drum. In order to ensure that the cable is accurately guided into the multiple grooves of the two cable drums so as to provide cable portions disposed side by side, it is necessary to drive the two cable drums in a perfectly synchronous manner, and in order to ensure uniform loading of the cable drums even in cases in which heavy loads have to be handled, the grooves of both cable drums will have to be formed with a depth which continuously increases in the direction in which the cable is paid out so that the desired continuous reduction of the pulling force exerted on the load-bearing cable is actually attained, said reduction being provided by means of this cable winch in the individual successive helical grooves of the two cable drums for the purpose of precluding excessive elongation and an attendant risk of fracture.

In DE-OS No. 25 17 796 there is disclosed a so-called pull-through winch in which there is mounted on the drive shaft of a cable drum provided with a grooved cylindrical shell a clamping disk defining a clamping groove for the paid-out length of cable and adapted to be driven in synchronism with the cable drum, said clamping disk being adapted, during hauling-in of a load, to apply a clamping force produced by a stack of Belleville springs capable of being pretensioned onto the load-bearing cable paid out in a tension-free manner from the discharge groove of the cable drum, said clamping force being applied transversely of the paying-out direction.

Such a pull-through winch can only be employed to haul in a load, not, however, as a device which is adapted to raise and lower a load, it being noted that the provision of the cable drum with multiple grooves results in correspondingly high costs of manufacture. In a pull-through winch belonging to a similar category disclosed in DE-OS No. 29 39 993 there is provided a clamping disk arrangement which is pretensionable in an axial direction by means of a spring, the axis of this spring arrangement being disposed parallel to the axis of a cylindrical shell of a cable drum which is of cylindrical shape and may be smooth or provided with grooves, said clamping disk arrangement being adapted intermittently to cooperate with drive pawls disposed within the cable drum. Also this known pull-through winch is only adapted for hauling-in a load, and particularly the clamping disk arrangement causes relatively high manufacturing costs.

OBJECT OF THE INVENTION

It is an object of the present invention, using simple means, to construct a portable cable winch of the kind mentioned in such a way that, employing a load-bearing cable of great length and avoiding wrapping of the cable drum by a plurality of cable layers, it is possible to drive the cable drum by means of a drive motor of moderate power producing a torque which is a constant as possible so that the cable winch is adapted to both hauling-in and raising and lowering of loads, it being contemplated that these two alternatives be provided by the manufacturer of the winch.

SUMMARY OF THE INVENTION

According to the invention, this object is attained by the provision of a cable winch of the aforeindicated type in which the drum shell is of conical shape with the angle of inclination of the peripheral drum surface corresponding to the angle of friction between the load-bearing cable and the cable drum, the length of cable paid out from the end of the cable drum having the smaller diameter being deflected towards cable storing means by a clamping disk which is adapted to be driven in synchronism with the cable drum.

In a cable winch constructed in this manner the cable drum exclusively operates as a driving drum for the load-bearing cable, the conical shell of the drum carrying a number of turns of the cable disposed side by side which is sufficient to permit the maximum desired pulling force to be produced in accordance with the law governing cable friction. Under such conditions, the peripheral force U capable of being transmitted by the cable drum is given as the difference between the cable forces $S_1$ and $S_2$ exerted on the drum by the cable sections which are respectively received and paid out, by the angle of wrap $\alpha$ and the angle of friction $\mu$ between the load-bearing cable and the shell of the cable drum in accordance with the following equations:

$$U=S_1-S_2 \quad (1)$$

$$S_1=S_2.e^{\mu}\alpha \quad (2)$$

$$U=S_2(e^{\mu}\alpha-1) \quad (3)$$

The conical shape of the shell of the cable drum with an angle of inclination which is identical with the angle of friction between the load-bearing cable and the drum not only prevents the individual cable turns from migrating on the shell in the direction of the drum axis but also the formation of a plurality of superimposed layers of cable turns with the result that the clamping force produced by the clamping disk, and more in particular in a clamping groove in which the cable is clamped by springs acting in an axial direction, acts on the cable section being paid out in a tension-free manner from the small-diameter end of the conical surface and is transmitted as a pulling force back to the cable section being drawn in. Thus, the cable winch is adapted to haul in a load through any desired distance.

If it is intended also to employ the cable winch as a hoisting gear adapted to raise and lower loads, it will be necessary that the smooth shell of the cable drum, in accordance with a preferred embodiment of the invention, be provided with two conical surfaces having the same angle of friction between the load-bearing cable and the cable drum, the two conical sections of the drum shell being oppositely inclined in relation of the drum axis, there being provided a guide pulley disposed parallel to the cable drum and adapted to cause the two conical surfaces of the drum alternatingly to receive a plurality of cable turns upon the direction of rotation of the drum being reversed. Since the angles of inclination of the two conical surfaces are opposed to one another, raising a load by means of one of the conical surfaces will cause the clamping disk to exert a clamping force which results in a pulling force on the cable section being hauled in, said pulling force then being transmitted via the second conical surface for the purpose of lowering the load with the cable drum being rotated in the opposite direction. Upon the direction of rotation of the cable drum being reversed, the multiple turns of the load-bearing cable received by one conical surface will be displaced towards the second conical surface and vice versa, the identity of the angles of inclination of the two conical surfaces with the friction angle between the cable and the drum ensuring that, upon completion of this displacement, both during raising and lowering a load any further migration of the cable sections wrapping the respective conical surface in the direction of the drum axis is precluded, the individual turns of the cable being prevented from being superimposed. This embodiment of the cable winch may also be employed for hauling in a load with only one of the two conical surfaces being operative continuously.

BRIEF DESCRIPTION OF THE DRAWINGS

The invention and further particulars will be described more specifically hereinafter with reference to preferred embodiments shown in the drawings, in which.

DETAILED DESCRIPTION OF THE PREFERRED EMBODIMENTS OF THE INVENTION

Figure 1:
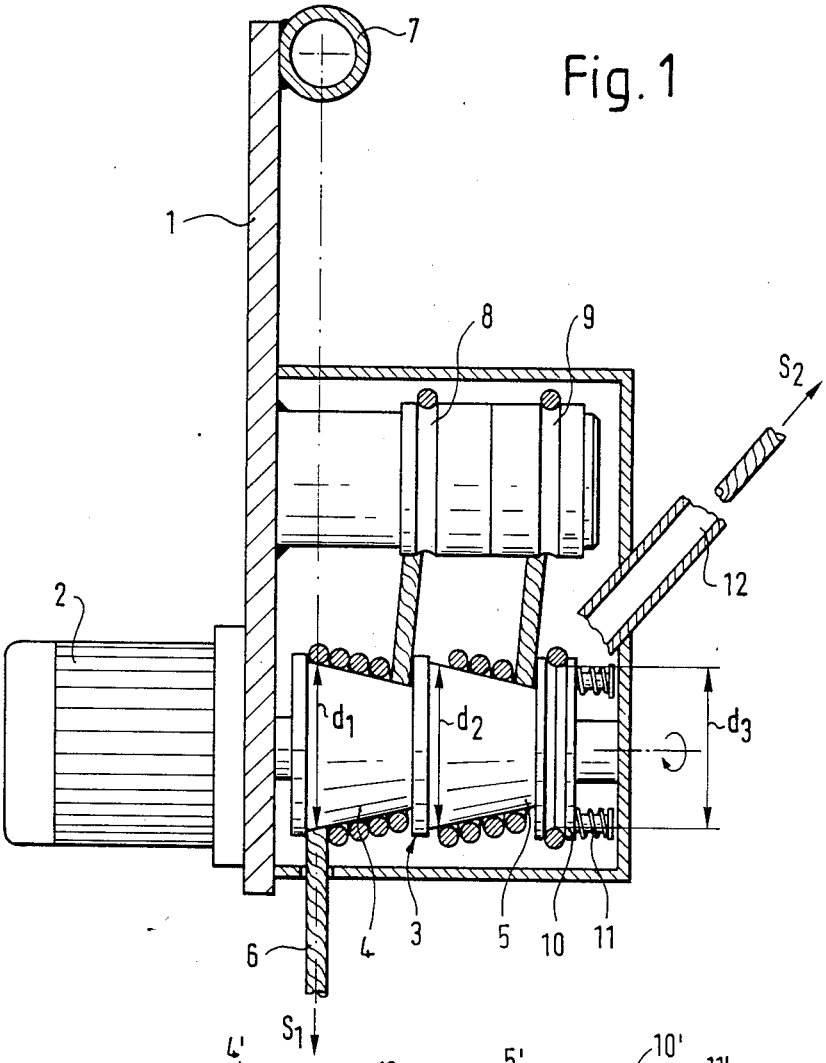
FIG. 1 is a longitudinal sectional view of an embodiment of the invention in the form of a cable winch which is exclusively adapted to haul in a load.

In the cable winch shown in FIG. 1, a mounting plate 1 supports a drive motor 2 for a cable drum 3 the shell of which is subdivided into two conical surfaces 4 and 5 having identical angles of inclination. The angle of inclination of each of the two conical surfaces 4 and 5 corresponds to the angle of friction between the load-bearing cable 6 and the cable drum 3, this ensuring that the cable section being hauled in at the larger-diameter end of the conical surface 4 will be held in alignment with a guiding eye 7, provided on mounting plate 1, which constitutes a stationary support for cable drum 3 and a means by which the cable winch can be attached to a vehicle or other object. For example, the cable winch can be attached to a vehicle by means of linchpins inserted into the guiding eye 7. Since the angle of inclination of conical surface 4 has been specially selected in the manner described, the individual turns of load-bearing cable section 6 are caused to be disposed in a side by side manner on conical surface 4 along the shell of the drum, and this excludes the risk of the cable forming a plurality of superimposed layers of turns, the result being that cable drum 3 exclusively operates as a pull-through drum for load-bearing cable 6 which is then paid out by the smaller-diameter section of conical surface 4 so as then to be deflected towards cable drum 3 by means of a guide roller 8 whose axis is disposed parallel to the drum axis, the load-bearing cable 6 then being guided back to the larger-diameter section of second conical surface 5. In order to produce at this second stage of wrapping the cable about the drum a pulling force acting on the first stage in the direction of the clamping disk 10, the larger diameter $d_2$ of conical surface 5 is identical with or larger than the largest diameter $d_1$ of conical surface 4, and because also conical surface 5 has an angle of inclination corresponding to the angle of friction between cable 6 and cable drum 3, the cable section of cable 6 intended to wrap conical surface 5 will retain its position in which its individual turns are disposed side by side, the result being that the risk of migrating of the cable in the direction of the drum axis and of a plurality of cable turn layers being formed is excluded. The cable section paid out at the smaller-diameter end of conical surface 5 is again deflected by means of a guide pulley 9 disposed coaxially with guide pulley 8 and is then guided back to a clamping disk 10 which is secured to the shaft driving cable drum 3 so as to be driven in synchronism therewith.

Clamping disk 10 is subdivided into two members in the central plane of its clamping groove, and the two clamping disk members which are freely movable in relation to one another in an axial direction are elastically pretensioned towards one another by springs 11 so that cable 6 guided by the clamping groove of clamping disk 10 is subjected, by springs 11, to a clamping force which is transmitted back through the conical surfaces 5 and 4 for the purpose of having a pulling force exerted by cable 6. The diameter $d_3$ of the of clamping disk 10 at the clamping groove is identical with or larger than the diameter $d_2$ of conical surface 5 of drum 3 by way of which the clamping force acts back through the conical surface 5 as a first stage of a pulling force with the second stage thereof being transmitted by conical surface 4. As a load is hauled in, cable 6 is deflected by clamping disk 10 towards a cable storing means 12. In order to permit the distal end of the cable to be attached to a load to be hauled in by means of the cable winch, it is only necessary to remove the clamping force acting in the clamping groove of clamping disk 10 by axially spreading apart the two clamping disk members. Load-bearing cable 6 can then be pulled out by its distal end from cable storing means 12 by applying a pulling force. After the distal end of the cable has been attached to the load, the clamping force of clamping disk 10 is restored and then the cable drum drive means 2 are operated at a constant torque produced by drive motor 2 until the load has been hauled in up to the desired distance from the winch.

It is also possible to provide drum 3 of the cable winch with a single conical surface only and, in addition, to omit a guide pulley disposed parallel to the axis of the cable drum. In this case the cable section paid out will be immediately introduced into the clamping groove of the clamping disk which, rather than being disposed on the cable drum driving shaft, may also be disposed for driving in synchronism therewith on a shaft whose axis is arranged parallel to the cable drum axis. Moreover, it is possible to subdivide the shell of cable drum 3 into more than two conical surfaces having identical angles of inclination so that it is possible with a drive motor 2, the power of which can be regulated in a suitable manner, to vary the pulling force to be exerted by means of the load-bearing cable during hauling-in of a load.

Figure 2:
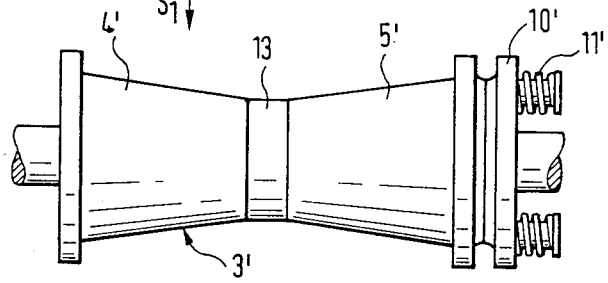
FIG. 2 is a side elevation of a modification of the cable winch of FIG. 1 which is also adapted to raise and lower loads.

Shown in FIG. 2 is a cable drum 3' for a cable winch as represented in FIG. 1 in which the two conical surfaces 4' and 5' have identical angles of inclination again corresponding to the angle of friction between the load-bearing cable and the cable drum, in which, the two angles of inclination of the two conical surfaces are opposed in the direction of the cable drum axis. At their smaller-diameter ends the two conical surfaces 4' and 5' are interconnected by a cylindrical shell section 13 which may also be rounded in cross-section. If the cable winch is provided with such a cable drum 3' it may be employed as a hoisting gear for raising and lowering loads. With cable drum 3' being driven in rotation in the direction in which a load will be raised, the load-bearing cable will be hauled in at the larger-diameter end of conical surface 4' and, after forming a plurality of turns on this conical surface, will be paid out at the smaller-diameter end or from the cylindrical shell section 13 whence the paid-out cable section will be returned to the clamping disk 10' mounted on the cable drum driving shaft via a guide pulley (not shown) whose axis extends parallel to the axis of cable drum 3', said clamping disk 10', in similarity to clamping disk 10 described earlier, comprising two clamping disk members so that the load-bearing cable deflected thereby towards a cable storing means is subjected to a clamping force by springs 11'. The diameter $d_3$ of the clamping disk 10 at the clamping groove is identical with or larger than the diameter of the larger-diameter ends of the two conical surfaces 4' and 5' so that the clamping force is transmitted as a pulling force to the load-bearing section of the cable 6 via conical surface 4'. It is also possible by causing cable drum 3' to rotate in this particular direction to employ the cable winch for hauling in a load since, due to the angle of inclination of conical surface 4', migration of the load-bearing cable along the drum axis is prevented as is the formation of a plurality of cable coil layers.

When a load is to be lowered with the cable winch in accordance with FIG. 2, the direction of rotation of cable drum 3' is reversed. The multiple turns formed by the load-bearing cable section on conical surface 4' will first slide along the shell of conical surface 4' onto the conical surface 5' solely as a consequence of the reversal of the sense of rotation, with the result that the cable is now pulled in at the smaller-diameter end thereof, with the guide pulley supported for rotation about an axis parallel to the axis of cable drum 3' being axially displaced so as to be aligned with the larger-diameter end of conical surface 5'. Upon this displacement being completed, the angle of inclination of conical surface 5' which corresponds to the angle of friction between the load-bearing cable and the cable drum will act to prevent the load-bearing cable from migrating in the direction of the drum axis with the result that now the clamping force exerted by the clamping groove of clamping disk 10' will act on the cable being pulled in at the smaller diameter end of conical surface 5'.

The two conical surfaces 4 and 5 of cable drum 3 and the conical surfaces 4' and 5' of cable drum 3' may also be manufactured separately for being mounted on a common drive shaft. If the abutment constituted by the eye 7 is provided on mounting plate 1, it will not be necessary to provide any special cable guiding means for the cable section to be pulled in because alignment with this abutment is ensured regardless of the point at which the cable winch is erected.

What is claimed is:

1. A cable winch comprising a motor-driven cable drum operating as a pull-through type drum, a load-bearing cable held in position on said cable drum for a plurality of turns by a clamping force in the direction of a disk driven in synchronism with the cable drum, said cable drum including a shell having a conical shape and an angle of inclination throughout its entire length which corresponds to the angle of friction between said load-bearing cable and said cable drum, and wherein the load-bearing cable is pulled into the cable drum at the shell end having the larger diameter, wherein said clamping disk is mounted on a shaft driving said cable drum and a first guide pulley is rotatably supported for rotation about an axis parallel to the axis of said shaft, said first guide pulley for guiding said load-bearing cable between said cable drum and said clamping disk; and wherein said cable drum is subdivided into at least first and second conical surfaces having identical angles of inclination and disposed in identical attitudes to extend in the direction of the axis of said cable drum, the diameter of the larger diameter end of the first conical surface provided for pulling in said load bearing cable being identical with or smaller than the diameter of the larger-diameter end of the second conical surface which is wrapped by the section of said load-bearing cable which is paid out by the smaller-diameter end of the first conical surface, the cable section deflected by a second guide pulley whose axis extends parallel to the drum axis.

2. The cable winch of claim 1 wherein the shell of said cable drum has a smooth peripheral surface.

3. The cable winch of claim 2 wherein said clamping disk includes a clamping groove, the diameter of said clamping groove being identical with or larger than the diameter of the larger-diameter end of said conical shaped shell.

4. The cable winch of claim 3, characterized in that said clamping disk is subdivided in the plane of said clamping groove into two clamping disk members which are mounted to be moved in relation to one another in an axial direction and which are preloaded towards one another by elastic spring means.

5. The cable winch of claim 1, characterized in that the diameter of a clamping groove with which said clamping disk is provided is identical with or larger than the diameter of the larger-diameter end of the second conical surface of said cable drum.

6. The cable winch of claim 1 wherein said second guide pulley is rotatably supported coaxially with said first guide pulley.

7. A cable winch comprising a motor-driven cable drum operating as a pull-through type drum, a load-bearing cable held in position on said cable drum for a plurality of turns by a clamping force in the direction of a disk driven in synchronism with the cable drum, said cable drum including a shell having a conical shape and an angle of inclination throughout its entire length which corresponds to the angle of friction between said load-bearing cable and said cable drum, wherein the load-bearing cable is pulled into the cable drum at the shell end having the larger diameter, and wherein the shell of said cable drum is subdivided into two conical surfaces having identical angles of inclination and disposed on the axis of said cable drum with the conical surfaces extending in opposite directions and that said load-bearing cable is supported by a guide pulley rotatably mounted parallel with the shell, which deflects the cable being paid off the shell to the said clamping disk.

8. The cable winch of claim 7, characterized in that the two conical surfaces are interconnected at their smaller-diameter ends.

9. The cable winch of claim 8, characterized in that the section of said drum connecting the two conical surfaces is of rounded cross section.

10. The cable winch of claim 8 or 9, characterized in that said section connecting the two conical surfaces of said cable drum is formed as a shell section of cylindrical shape.

11. The cable winch of claim 1 wherein said plurality of turns of said load-bearing cable are disposed side by side on the conical shell and said plurality of turns includes as many turns of the load-bearing cable as are necessary to attain a desired pulling force.

12. The cable winch comprising a motor-driven cable drum operating as a pull-through type drum, a load-bearing cable held in position on said cable drum for a plurality of turns by a clamping force in the direction of a disk driven in synchronism with the cable drum, said cable drum including a shell having a conical shape and an angle of inclination throughout its entire length which corresponds to the angle of friction between said load-bearing cable and said cable drum, wherein the load-bearing cable is pulled into the cable drum at the shell end having the larger diameter, and wherein said cable drum is subdivided into at least first and second conical surfaces having identical angles of inclination and disposed in identical attitudes to extend in the direction of the axis of said cable drum, the diameter of the larger diameter end of the first conical surface provided for pulling in said load-bearing cable being identical with or smaller than the diameter of the larger-diameter end of the second conical surface which is wrapped by the section of said load-bearing cable which is paid out by the smaller-diameter end of the first conical surface, the cable section deflected by a first guide pulley whose axis extends parallel to the drum axis.

13. The cable winch of claim 12 further including a second guide pulley rotatably supported coaxially with said first guide pulley, said second guide pulley for deflecting the load-bearing cable section to be paid out by the smaller diameter end of the second conical surface.

14. The cable winch of claim 12, wherein said angle of inclination is constant throughout the entire length of said shell.

15. The cable winch of claim 12, wherein said angle of inclination is approximately equal to the angle of friction.

16. The cable winch of claim 12, wherein said angle of inclination is equal to the angle of friction.

17. The cable winch of claim 11 or 14 or 15 or 16 wherein the shell of said cable drum has a smooth peripheral surface.

18. A cable winch comprising a motor-driven cable drum operating as a pull-through type drum, a load-bearing cable held in position on said cable drum for a plurality of turns by a clamping force in the direction of a cable storing means, said clamping force generated by a clamping disk driven in synchronism with the cable drum, said cable drum including a shell having a conical shape and an angle of inclination corresponding to the angle of friction between said load-bearing cable and said cable drum, wherein the load-bearing cable is pulled from the cable drum at the shell end having the smaller diameter to the cable storing means while the load-bearing cable is pulled into the cable drum at the shell end having the larger diameter, wherein said cable drum is subdivided into at least first and second conical surfaces, the first and second conical surfaces disposed in identical attitudes to extend in the direction of and parallel to the axis of said cable drum and parallel to each other, and wherein the diameter of the larger diameter end of the first conical surface provided for pulling in said load-bearing cable is identical with or smaller than the diameter of the larger-diameter end of the second condical surface which is wrapped by the section of said loadbearing cable which is paid out by the smaller-diameter end of the first conical surface, the cable section deflected by a guide pulley whose axis extends parallel to the drum axis.

19. The cable winch of claim 18 wherein the angle of inclination corresponds to the angle of friction throughout the entire length of the shell.

20. The cable winch of claim 18 wherein said angle of inclination is approximately equal to the angle of friction.

21. The cable winch of claim 18 wherein said angle of inclination is constant throughout the entire length of said shell.

22. A cable winch comprising a motor-driven cable drum operating as a pull-through type drum, a load-bearing cable held in position on said cable drum for a plurality of turns by a clamping force in the direction of a cable storing means, said clamping force generated by a clamping disk driven in synchronism with the cable drum, said cable drum including a shell having a conical shape and an angle of inclination corresponding to the angle of friction between said load-bearing cable and said cable drum, wherein the load-bearing cable is pulled from the cable drum at the shell end having the smaller diameter to the cable storing means while the load-bearing cable is pulled into the cable drum at the shell end having the larger diameter, and wherein said cable drum is subdivided into at least first and second conical surfaces having identical angles of inclination and disposed in identical attitudes to extend in the direction of the axis of said cable drum, the diameter of the larger diameter end of the first conical surface provided for pulling in said load-bearing cable being identical with or smaller than the diameter of the larger-diameter end of the second conical surface which is wrapped by the section of said load-bearing cable which is paid out by the smaller-diameter end of the first conical surface, the cable section deflected by a first guide pulley whose axis extends parallel to the drum axis.

23. The cable winch of claim 22 wherein said plurality of turns of said load-bearing cable are disposed side by side on the conical shell and said plurality of turns includes as many turns of the load-bearing cable as are necessary to attain a desired pulling force.

24. The cable winch of claim 22 wherein the shell of said cable drum has a smooth peripheral surface.

25. The cable winch of claim 22 wherein said clamping disk includes a clamping groove, the diameter of said clamping groove being identical with or larger than the diameter of the larger-diameter end of said conical shaped shell.

26. The cable winch of claim 22, characterized in that said clamping disk is subdivided in the plane of a clamping groove of said clamping disk into two clamping disk members which are mounted to be moved in relation to one another in an axial direction and which are preloaded towards one another by elastic spring means.

27. The cable winch of claim 22, further including a second guide pulley, rotatably supported coaxially with said first pulley, said second guide pulley for deflecting the load-bearing cable section to be paid out by the smaller diameter end of said second conical surface.

28. The cable winch of claim 22 or 23 or 24 or 25 wherein said clamping disk is mounted on a shaft driving said cable drum and a second guide pulley is rotatably supported for rotation about an axis parallel to the axis of said shaft, said second guide pulley for guiding said load-bearing cable between said cable drum and said clamping disk.

29. The cable winch of claim 22 or 23 or 24 or 25 or 26 wherein the angle of inclination of the shell corresponds to the angle of friction throughout the entire length of the shell.

30. Tha cable winch of claim 22 or 23 or 24 or 25 or 26 wherein said angle of inclination is approximately equal to the angle of friction.

31. A cable winch comprising a motor-driven cable drum operating as a pull-through type drum, a load-bearing cable held in position on said cable drum for a plurality of turns by a clamping force in the direction of a cable storing means, said clamping force generated by a clamping disk driven in synchronism with the cable drum, said cable drum including a shell having a conical shape and an angle of inclination corresponding to the angle of friction between said load-bearing cable and said cable drum, wherein the load-bearing cable is pulled from the cable drum at the shell end having the smaller diameter to the cable storing means while the load-bearing cable is pulled into the cable drum at the shell end have the larger diameter, and wherein the shell of said cable drum is subdivided into two conical surfaces having identical angles of inclination and disposed on the axis of said cable drum with the conical surfaces extending in opposite directions and that said load-bearing cable is supported by a guide pulley rotatably mounted parallel with the shell, which deflects the cable being paid of the shell to the said clamping disk.

32. The cable winch of claim 31, characterized in that the two conical surfaces are interconnected at their smaller-diameter ends.

33. The cable winch of claim 32, characterized in that the section of said drum connecting the two conical surfaces is of rounded cross section.

34. The cable winch of claim 32, characterized in that said section connecting the two conical surfaces of said cable drum is formed as a shell section of cylindrical shape.

35. The cable winch of claim 31 wherein said plurality of turns of said load-bearing cable are disposed side by side on the conical shell and said plurality of turns includes as many turns of the load-bearing cable as are necessary to attain a desired pulling force.

36. The cable winch of claim 31 wherein the shell of said cable drum has a smooth peripheral surface.

37. The cable winch of claim 31 wherein the angle of inclination corresponds to the angle of friction throughout the entire length of the shell.

38. The cable winch of claim 31 wherein the angle of inclination is approximately equal to the angle of friction.

* * * * *